US007328675B2

(12) United States Patent
Seitz et al.

(10) Patent No.: US 7,328,675 B2
(45) **Date of Patent: *Feb. 12, 2008**

(54) FINGER LEVER OF A VALVE DRIVE OF A COMBUSTION ENGINE

(75) Inventors: Joachim Seitz, Frensdorf (DE); Bodo Rorig, Weisendorf (DE); Anteo Opipari, Royal Oak, MI (US)

(73) Assignee: Schaeffler KG, Herzogenaurach (DE)

( * ) Notice: Subject to any disclaimer, the term of this patent is extended or adjusted under 35 U.S.C. 154(b) by 86 days.

This patent is subject to a terminal disclaimer.

(21) Appl. No.: 10/554,346

(22) PCT Filed: Mar. 9, 2004

(86) PCT No.: PCT/EP2004/002369

§ 371 (c)(1),
(2), (4) Date: Jan. 31, 2006

(87) PCT Pub. No.: WO2004/094791

PCT Pub. Date: Nov. 4, 2004

(65) Prior Publication Data

US 2007/0006837 A1 Jan. 11, 2007

(30) Foreign Application Priority Data

Apr. 23, 2003 (DE) ..... 103 18 295

(51) Int. Cl.
*F01L 1/18* (2006.01)

(52) U.S. Cl. ..... 123/90.39; 123/90.44; 74/559

(58) Field of Classification Search ..... 123/90.16, 123/90.2, 90.39, 90.41, 90.44; 74/559, 567, 74/569

See application file for complete search history.

(56) References Cited

U.S. PATENT DOCUMENTS

| | | | |
|---|---|---|---|
| 4,203,397 | A | 5/1980 | Soeters, Jr. |
| 4,617,880 | A | 10/1986 | Yoshizaki |
| 5,653,198 | A | 8/1997 | Diggs |
| 5,655,488 | A | 8/1997 | Hampton et al. |
| 5,682,848 | A | 11/1997 | Hampton et al. |
| 6,318,318 | B1 | 11/2001 | Jahr |
| 6,532,920 | B1 | 3/2003 | Sweetnam et al. |

FOREIGN PATENT DOCUMENTS

| | | |
|---|---|---|
| DE | 42 12 844 | 10/1993 |
| DE | 43 21 308 | 7/1994 |
| DE | 44 10 288 | 6/1995 |
| DE | 196 06 796 | 11/1996 |
| DE | 101 58 703 | 7/2002 |
| DE | 102 11 038 | 11/2002 |

*Primary Examiner*—Ching Chang
(74) *Attorney, Agent, or Firm*—Volpe and Koenig, PC

(57) ABSTRACT

A finger lever (1) that can be switched for different cam lifts is provided. The finger lever includes an outer arm (2), between whose limbs (3) an inner arm (4) is pivotally mounted. Inside the inner arm (4), starting form one end (9), a blind borehole (16) is provided with a coupling element (5), which can be longitudinally displaced therein and which, in the event of coupling, can be displaced partially under a driver surface (18) of a crossbar (15) of the outer arm (2). Height stopping parts (34) are provided on the inner arm (4) in the form of a simple, finger-like extension of the inner arm (4) at the end (9) thereof which extend out over the crossbar (15).

16 Claims, 1 Drawing Sheet

FINGER LEVER OF A VALVE DRIVE OF A COMBUSTION ENGINE

FIELD OF THE INVENTION

The invention relates to a finger lever of a valve drive of an internal combustion engine, which can be switched to different lifts for at least one gas-exchange valve, with an outer arm between whose limbs an inner arm extends. Both arms can be pivoted relative to each other and can be coupled to each other through a coupling means, so that when coupled a larger valve lift is generated and when decoupled a smaller or 0 valve lift is generated. A stop for a gas-exchange valve is applied at one end on a bottom side of the finger lever and a complementary surface for a support element is applied on the other end. In addition, at least one counter surface for a large lifting lobe is provided on a top side of the outer arm and a counter surface for a small or 0 lifting lobe is provided on a top side of the inner arm.

A finger lever of this type is already known from DE-OS 27 53 197. As coupling means, a catch is provided, which catches underneath the inner arm and can be displaced by means of a complicated linkage mechanism. In a disadvantageous way, the catch increases the overall height of the switchable finger lever. At the same time, the external loading by means of the linkage has proven to be relatively complicated.

BACKGROUND OF THE INVENTION

From DE 102 11 038 A1, a switchable rocker arrangement also emerges, in whose outer arm a slide for coupling is arranged. This slide can be displaced by electromagnetic means arranged externally. Here, it is also clear that this external loading of the slide unnecessarily increases the required installation space for the switchable finger lever in the cylinder head region. Thus, the previously mentioned finger lever is also built undesirably long. In addition, it has been determined that relatively large forces and thus component loads in the coupling region must be taken into account due to the relatively short inner arm when it is coupled to the outer arm.

SUMMARY OF THE INVENTION

Therefore, the object of the invention is to create a finger lever of the previously mentioned type, for which the cited disadvantages are overcome through simple means.

According to the invention, this problem is solved, in that the limbs of the outer arm are connected by a crossbar in a region of the end at a complementary surface for the support, wherein in the inner arm, a smooth surfaced blind borehole is located above the complementary surface and extends from the end and includes a slide that can be displaced therein in the longitudinal direction as coupling means. This slide for the coupling of the arm can be displaced out of the blind borehole so that it catches below a driver surface of the crossbar provided as the bottom side, wherein the inner arm has an essentially smooth surface on its top side up to the counter surface and at least one finger-like height stopping means for the outer arm extends over the crossbar from the inner arm that is at least for the most part aligned with a top side thereof on the side of its complementary surface, and wherein the inner arm is connected to the limbs of the outer arm in a region of an end on the side of the gas-exchange valve so that it can pivot.

Thus, a switchable finger lever is provided, for which the cited disadvantages are eliminated through simple means.

Viewed overall, also in its height direction, the finger lever is built very compact, so that for subsequent implementation in completed cylinder heads for non-switchable valve drives, no major problems are to be expected or several lines of engines can be equipped.

Due to the coupling means (slide) with its pressure space lying directly above the complementary surface for the support element, only very short hydraulic paths are provided. Also, it is determined that only relatively small component loading must be taken into account due to the favorable arm ratios in the coupling region. The blind borehole for the coupling means can also be produced simply in one processing step, wherein it is especially advantageous that the inner arm has height stops that project "flat" from the inner arm. For the coupling case, this can represent outstanding positional correspondence for the blind borehole with the catch surface and simultaneously a safety device against loss.

The slide should be displaced outwards in the longitudinal direction for the coupling position, but it is also conceivable to displace this inwards to produce a coupling. For the coupling position, the slide catches preferably under the bottom side of a crossbar of the outer arm lying in the region using simple means and methods. However, it is also conceivable to provide a corresponding recess for the slide in the crossbar.

Stopping means for limiting the coupling motion on the crossbar can be located opposite the slide. Thus, a sleeve in the blind borehole is provided, on whose one end the slide is subjected to path limitation. However, tab-like projections or stops of a general type can also be provided on the bottom side of the crossbar. In the case of a borehole or the like, the borehole can be provided with a stop as the coupling surface in the crossbar. For this purpose, it is also provided to form the borehole with steps.

It is especially preferred when the slide is pushed in only one displacement direction via hydraulic medium pressure and in its other direction by the force of a spring means, such as a coil compression spring. However, it is also conceivable to displace this slide in both directions hydraulically or to provide the force of another servo means, such as, for example, an electromagnet, a magnet, or the like, in at least one direction.

Due to the integral formation of the circular expanded portion of the slide with the section actually implementing the coupling, according to another dependent claim, a slide that is economical to produce is provided. Optionally, a multi-part formation is also conceivable.

To minimize the production expense, especially for a sheet-metal formation, alternatively the blind borehole for the slide can also be applied in a separate insert. This is connected to the inner arm by a connection known to someone skilled in the art, thus, for example, through welding, swaging, press-in, or the like. However, an integral production is preferred.

Instead of the coil compression spring for the slide, other pressure-exerting means, such as plate springs, spiral springs, etc., are also conceivable. A use of magnetic means is also conceivable.

According to another aspect of the invention, it is proposed to have a tab-like projection extend from a top side of the crossbar of the outer arm in the region of the slide. This projection prevents undesired extension of the slide over the top side of the crossbar for the decoupled movement of the outer arm.

In addition, according to the invention the arm is to be produced from a lightweight material, such as sheet metal. This has an advantageous effect on the total mass of the finger lever and also on the production costs. However, a casting formation (precision casting) of the finger lever is also conceivable. Alternatively, the finger lever can also be produced in a metal injection-molding process (MIM—"Metal Injection Molding").

BRIEF DESCRIPTION OF THE DRAWING

The invention is explained in more detail preferably with reference to the drawings. Shown are.

DETAILED DESCRIPTION OF THE PREFERRED EMBODIMENTS

Figure 1:
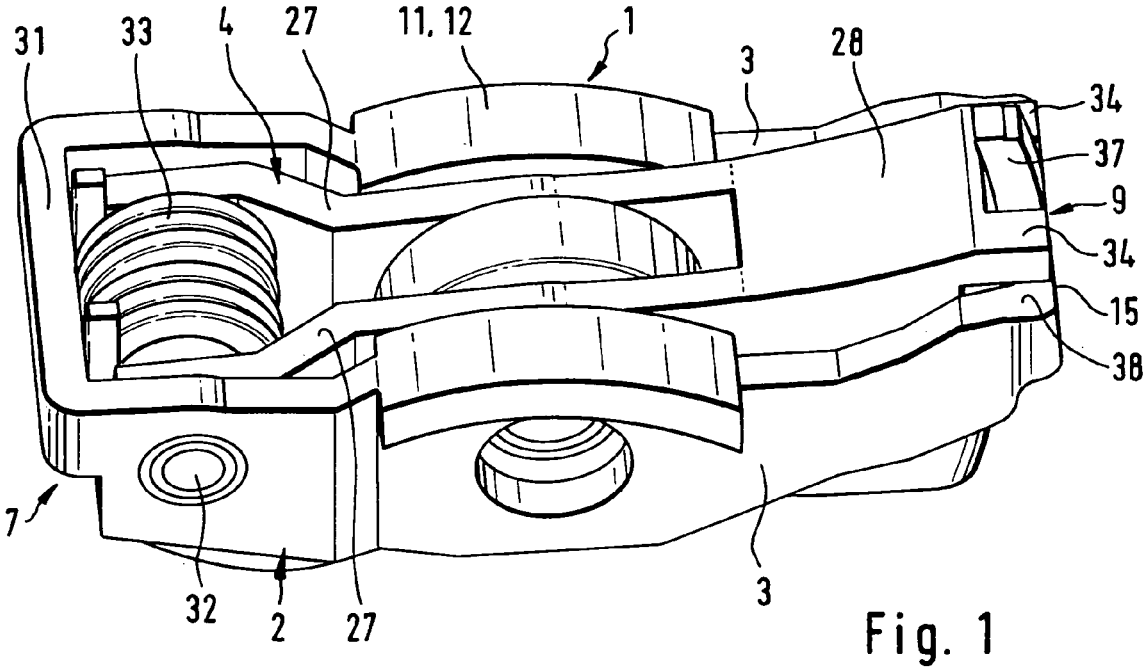
FIG. 1 a perspective view of a finger lever according to the invention.

The Figures show a finger lever 1 that can be switched for different cam lifts. This arm includes an outer arm 2, which is connected to one end 9 by a crossbar 15. An inner arm 4 lies between limbs 3 of the outer arm 2 and is connected in an articulated way to the outer arm 2 in the region of the other end 7. For this purpose, the inner arm 4 moves on an axle 32, whose outer ends extend axially into boreholes of the limbs 3 of the outer arm 2.

A swivel-pin spring, which surrounds the axle 32 within the inner arm 4, is provided as the lost-motion spring 33. In the decoupled case of the outer arm 2 from the inner arm 4, a restoring motion is exerted through the action on the limbs of the inner arm, not explained in further detail, on the outer arm 2.

In the approximate region of the center, the limbs 3 of the outer arm 2 each have on their top side 11 a counter surface 12 for large lifting lobes. This counter surface 12 is embodied as a sliding surface. In contrast, the inner arm 4 also has in the region of this center area, in the section of its top side 13, a counter surface 14 for a small lifting lobe. Here, this counter surface 14 is shown as a rotatable roller. Also to be seen here is that the outer arm 2 is closed in the region of the end 7 by a crossbar 31, so that, viewed overall in top view, it forms a rectangular-like profile.

On a bottom side 6 (see FIG. 2), the inner arm 4 has a contact 8 for a gas-exchange valve in the region of the end 7. On the opposite end 9, in the bottom side 6 of the inner arm 4, a dome-shaped complementary surface 10 is formed. By means of this complementary surface 10, the inner arm and thus the entire finger lever 4, 1 lies on a head of a support element, not shown in the Figure. Also to be seen is that the complementary surface 10 is located beneath a pressure space 19, which is bordered on one end by a base 16*a* of a smooth-surfaced blind borehole 16 and on the other end by a piston surface 20 of a circular expanded portion 17*a* of a slide 17 which forms a coupling means 5. From the complementary surface 10, a path 20*a* extends diagonally downwards in the arm direction, which intersects the pressure space 19 and thus provides this space with hydraulic medium.

The slide 17 includes the mentioned circular expanded portion 17*a*, which is positioned directly in the blind borehole 16. A smaller sized section 23 contacts the circular expanded portion 17*a* on the side facing out of the blind borehole 16. This section has an end 35 axially on the outside.

Figure 2:
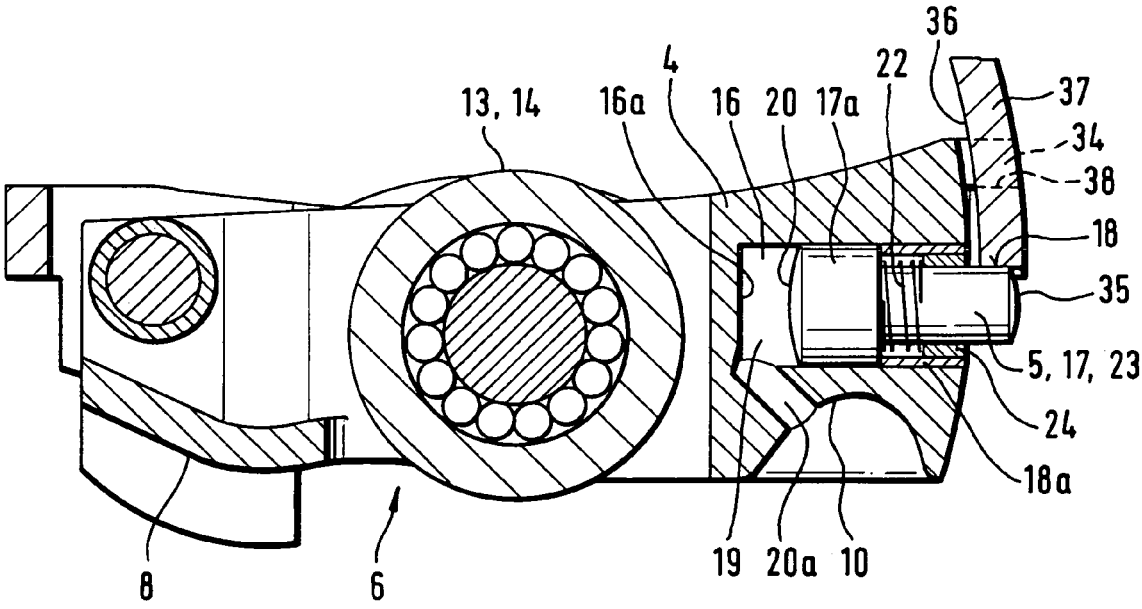
FIG. 2 a longitudinal cross-section through the finger lever along its longitudinal center line.

Stopping means 18*a* extend in the blind borehole 16 in a region of the section 23. Here, the stop is produced as a thin-walled ring, which is fixed with its outer surface directly in the blind borehole 16. Here, FIG. 2 shows the stopping (coupled) state of the slide 17 against the stopping means 18*a*. Thus, the slide is prevented from further undesired movement.

Also to be seen is that a spring means 22 is on the section 23. This is supported axially on the inside on the circular expanded portion 17*a*. Axially outwardly, the spring means 22 contact a sleeve 24. The section 23 projects directly through the sleeve 24, which extends with its outer surface in a bore of the stopping means 18*a*.

FIG. 2 shows the coupling state of the outer arm 2 with the inner arm 4. If both arms 2, 4 are decoupled for a base circle passage of the contacting cam, then the pressure space 19 is depressurized from hydraulic medium pressure, such that the slide 17 travels axially inwards into the blind borehole 16 by means of the force of the spring means 22. Thus, it no longer catches below a driver surface 18 of the crossbar 15 of the outer arm 2. Thus, the finger lever 1 merely follows the lift of the small lifting lobe applying a force on the inner arm 4. The outer arm 2 completes a return lift motion relative to the inner arm 4. The slide 17 is coupled using means and methods known to those skilled in the art by means of hydraulic medium pressure against the force of the spring means 22.

As follows from FIG. 1, it is further provided to arrange two height stopping means 34 which are extensions of the limbs 27 of the inner arm 4 on the top side 13 of the inner arm 4 in the region of the end 9. Here, these project flush as "smooth" extensions on the top side 13 in the direction towards the end 9 and are embodied as fingers. They project over a top side 38 of the crossbar 15 of the outer arm 2. Thus, for its return pivoting motion from the decoupled state, the outer arm 2 is subject to outstanding position fixing relative to the inner arm 4. The slide 17 can catch under the driver surface 18 of the outer arm 2 at a known fixed point when necessary.

Also noted is that a tab-like projection 37 extends from the top side 38 of the crossbar 15. Thus, for the pivoting motion of the outer arm 2 in the decoupled case, the outer end 35 of the slide 17 is always opposite an inner side 36 of the projection 37 or the crossbar 15. Undesired movement of the slide 17 over the top side 38 of the crossbar 15 is thus prevented.

LIST OF REFERENCE NUMBERS

1 Finger lever
2 Outer arm
3 Limb
4 Inner arm
5 Coupling means
6 Bottom side
7 End
8 Contact
9 End
10 Complementary surface
11 Top side
12 Counter surface
13 Top side
14 Counter surface
15 Crossbar
16 Blind borehole
16*a* Base
17 Slide

17*a* Circular expanded portion
18 Driver surface
18*a* Stopping means
19 Pressure space
20 Piston surface
20*a* Path
21 not assigned
22 Spring means
23 Section
24 Sleeve
25 not assigned
26 not assigned
27 Limb
28 Cross piece
29 not present
30 not assigned
31 Crossbar
32 Axle
33 Lost-motion spring
34 Height stopping means
35 End
36 Inner side
37 Projection
38 Top side

The invention claimed is:

1. A finger lever for a valve drive of a combustion engine, which can be switched to different lifts for at least one gas-exchange valve, comprising an outer arm and an inner arm located between limbs of the outer arm, wherein both arms can pivot relative to each other and can be coupled to each other by a coupling, so that when coupled, a large valve lift is generated and when decoupled, a small or 0 valve lift is generated, wherein a contact for a gas-exchange valve is provided on a bottom side of the finger lever on a first end and a complementary surface for a support element is located on a second end, and also at least one counter surface for a large lifting lobe is provided on a top side of the outer arm and a counter surface for a small or 0 lifting lobe is provided on a top side of the inner arm, the limbs of the outer arm are connected in a region of the second end for the complementary surface by a crossbar, wherein a smooth-surfaced blind borehole is located above the complementary surface and starting from the second end, the coupling includes a slide is located in the inner arm, which can be displaced longitudinally therein, and the slide can be displaced from the blind borehole for coupling of the arms, so that the slide catches under a driver surface of the crossbar formed as a bottom side in part of the outer arm, wherein the inner am is essentially smooth surfaced on the top side up to the counter surface, and at least one finger-like height stop for the outer arm extends out from the inner arm over the crossbar generally flush with the top side on a side with the complementary surface, and wherein the inner arm is connected to the limbs of the outer arm so that it can pivot in a region of the first end on a side of the gas-exchange valve.

2. The finger lever according to claim 1, wherein the slide can be displaced in a coupling direction by a hydraulic medium force, wherein for this purpose, a pressure space for hydraulic medium is formed in the blind borehole, with the space being bordered axially on one side by a base of the blind borehole and on an other side by a piston surface of an expanded portion of the slide, wherein the pressure space can be supplied with the hydraulic medium from a path extending from the complementary surface.

3. The finger lever according to claim 2, wherein displacement of the slide in a decoupling direction into the blind borehole is caused by a force of a spring with the spring, surrounding a section of the slide axially behind the expanded portion and acting on one end against the expanded portion and acting on an other end on a sleeve fixed at least indirectly in the blind borehole on a side of the second end.

4. The finger lever of claim 3, wherein the spring comprises a coil compression spring.

5. The finger lever according to claim 3, wherein the expanded portion of the slide is connected integrally to the slide.

6. The finger lever according to claim 3, wherein a stop is provided in the blind borehole for limiting a path of the slide from the blind borehole.

7. The finger lever according to claim 6, wherein the stop comprise a ring part which is fixed in the borehole, and the section of the slide projects through the ring part.

8. The finger lever according to claim 1, wherein the inner arm, has two limbs that extend approximately parallel to the limbs of the outer arm and the blind borehole is located in a cross piece connecting the two limbs and formed integrally with the inner arm.

9. The finger lever according to claim 1, wherein the inner arm has two limbs that extend approximately parallel to the limbs of the outer arm, wherein the blind borehole is applied in a separate cross piece which connects the two limbs.

10. The finger lever according to claim 9, wherein the separate cross piece is connected to the inner arm by an attachment process, and is selectively finished with impact extrusion.

11. The finger lever according to claim 10, wherein the attachment process comprises welding or pressing.

12. The finger lever according to claim 1, wherein a tab-like projection starts at a top side of the crossbar and the projection has a height, such that an outer end of the slide lies opposite an inner side of the projection during a complete decoupling of the outer arm from the inner arm.

13. The finger lever according to claim 1, wherein at least one of the arms generally comprises a lightweight material.

14. The finger lever according to claim 13, wherein the light weight material comprises stamped or deep drawn sheet metal or plastic fiber-reinforced plastic.

15. The finger lever according to claim 1, wherein at least one of the arms generally comprises a precision casting.

16. The finger lever according to claim 1, wherein at least one of the arms is generally produced in a metal injection molding process.

* * * * *